US012577717B2

(12) United States Patent
Hobbs et al.

(10) Patent No.: US 12,577,717 B2
(45) Date of Patent: Mar. 17, 2026

(54) CLEANING CYCLE FOR WHITE LAUNDRY ITEMS

(71) Applicant: Electrolux Home Products, Inc., Charlotte, NC (US)

(72) Inventors: Brian Hobbs, Charlotte, NC (US); Eduardo Palmeira, Charlotte, NC (US); Flavio Bernardino, Charlotte, NC (US)

(73) Assignee: Electrolux Consumer Products, Inc., Charlotte, NC (US)

( * ) Notice: Subject to any disclaimer, the term of this patent is extended or adjusted under 35 U.S.C. 154(b) by 522 days.

(21) Appl. No.: 17/940,277

(22) Filed: Sep. 8, 2022

(65) Prior Publication Data

US 2023/0081651 A1 Mar. 16, 2023

Related U.S. Application Data

(60) Provisional application No. 63/241,819, filed on Sep. 8, 2021.

(51) Int. Cl.
*D06F 33/36* (2020.01)
*D06F 33/56* (2020.01)
(Continued)

(52) U.S. Cl.
CPC ..... *D06F 33/36* (2020.02); *D06F 33/56* (2020.02); *D06F 34/22* (2020.02); *D06F 35/006* (2013.01);
(Continued)

(58) Field of Classification Search
CPC ..... D06F 33/36; D06F 33/56; D06F 34/22; D06F 35/006; D06F 2103/18; D06F 2105/02; D06F 2105/54
See application file for complete search history.

(56) References Cited

U.S. PATENT DOCUMENTS 6,553,595 B1 * 4/2003 Bruntz ..... D06F 34/28 68/12.22
2002/0138918 A1 * 10/2002 Johnson ..... D06F 34/30 68/12.27

(Continued)

OTHER PUBLICATIONS

International Search Report and Written Opinion for International Application No. PCT/US2022/042839, mailed Dec. 16, 2022, 14 pages.

*Primary Examiner* — Joseph L. Perrin
(74) *Attorney, Agent, or Firm* — Chrisman Gallo Tochtrop LLC

(57) ABSTRACT

A laundry washing machine having configured to receive a laundry cycle selection from a user interface; identify the cycle selection; upon receiving a normal laundry cycle selection, select a respective program comprising default instructions for: opening the valve one or more times to fill the drum to a default normal maintenance phase liquid level, and operating the drum motor during a normal maintenance phase to rotate the drum; and upon receiving a selection of the whites laundry cycle, select a respective program comprising default instructions for: opening the valve one or more times to fill the drum to a default whites maintenance phase liquid level, and operating the drum motor during a whites maintenance phase to cyclically rotate the drum. The default whites maintenance phase liquid level is equal to or less than the default normal maintenance phase liquid level. Methods of operating a laundry machine are also provided.

20 Claims, 6 Drawing Sheets

(51) Int. Cl.

| | |
|---|---|
| ***D06F 34/22*** | (2020.01) |
| *D06F 35/00* | (2006.01) |
| *D06F 103/18* | (2020.01) |
| *D06F 105/02* | (2020.01) |
| *D06F 105/54* | (2020.01) |

(52) U.S. Cl.
CPC ..... *D06F 2103/18* (2020.02); *D06F 2105/02* (2020.02); *D06F 2105/54* (2020.02)

(56) References Cited

U.S. PATENT DOCUMENTS

| | | | | |
|---|---|---|---|---|
| 2007/0169281 | A1 | 7/2007 | Ha | |
| 2008/0235613 | A1* | 9/2008 | Ricklefs | G05B 19/0426 715/779 |
| 2008/0235614 | A1* | 9/2008 | Ricklefs | G05B 19/0426 715/783 |
| 2014/0033449 | A1* | 2/2014 | Im | D06F 37/266 8/137 |

* cited by examiner

CLEANING CYCLE FOR WHITE LAUNDRY ITEMS

This application claims priority to U.S. Provisional Application Ser. No. 63/241,819, filed on Sep. 8, 2021, which is incorporated herein by reference.

BACKGROUND

A persistent problem in the field of fabric care has been to provide a cleaning cycle that is highly-effective at maintaining the whiteness of white fabric items. Typical white fabrics experience darkening as the fabric picks up and retains substances, such as dirt, sebum, blood, pollutants, pollen, smoke, ash, and so on (hereinafter referred to generically as "soil"). Captured soil may be colored, or it may change color over time, such as by capturing more soil or by chemical reactions.

A general goal of washing white fabrics is to maintain the whiteness, or return them to a white state. Washing with detergent can help remove some of the soil, and washing with bleach can bleach the soil to make it appear white. However, cleaning cycles are not effective at removing all of the soil, and bleach can damage the fabric fibers. Thus, a typical white laundry article will, despite the best efforts of the current technology, darken significantly during normal use and washing.

It is conventionally believed that this darkening over time is influenced mainly by two factors. First, is the effectiveness of the cleaning cycle at removing soil from the fabric. Lower removal effectiveness means less of the soil is removed during any given wash, and this allows faster accumulation of soil and more rapid darkening. Second, even if a cleaning cycle is effective at removing soil in the initial phase, the cleaning cycle may allow soil to redeposit on the laundry during the initial phase or in later phases of the process, thus leading to a net result that is less effective than the initial soil removal would suggest.

Efforts have been made in the past to improve white laundry cleaning cycles. Such changes are made within the bounds of the structural and operational variables presented by the laundry washing machine performing the process. A typical laundry washing machine has a wash tub, a drum rotatably mounted in the wash tub, and hot and cold water inputs. These features provide numerous variables that include, for example, tub size, drum size, drum rotation speed, internal drum features (e.g., lifting vanes), water temperature, water fill level, cleaning liquid delivery location and mixing, number and sequence of washing, rinsing and spinning cycles, and so on. The selection of treating chemistry and type (e.g. powder, liquid, unit dose package), and how such treating chemistry is distributed, also play a role.

One conventional approach to improving white cleaning performance is to use a relatively high volume of wash water during the initial washing cycles. This process is expected to effectively remove soil by providing a large liquid volume in which the fabric can move with relative freedom to allow greater agitation and thus greater initial soil removal. In addition, a large initial wash liquid volume allows the dirt to release into free liquid, and thus help prevent redepositing.

It has been found by the inventors, however, that such conventional approaches are actually relatively ineffective at maintaining the whiteness of fabrics over time. Thus, the inventors have determined that the state of the art still needs to be improved.

SUMMARY

In a first exemplary aspect, there is provided a laundry washing machine having: a cabinet; a tub mounted within the cabinet; a drum rotatably mounted within the tub; a drum motor configured to rotate the drum; a water supply; a valve selectively openable to direct water from the water supply to the tub; a heater; a user interface configured to receive a laundry cycle selection; and a control system comprising a processor and a memory storing operating instructions in a non-volatile memory. The operating instructions include instructions to: receive the laundry cycle selection from the user interface; and identify the laundry cycle selection from a plurality of laundry cycle selection options including at least a normal laundry cycle and a whites laundry cycle. Upon receiving a selection of the normal laundry cycle, the control system selects a normal laundry cycle program comprising respective default instructions for: opening the valve one or more times to fill the drum to a default normal maintenance phase liquid level, and operating the drum motor during a normal maintenance phase to cyclically rotate the drum according to a default normal cycle drum rotating schedule. Upon receiving a selection of the whites laundry cycle, the control system selects a whites laundry cycle program comprising respective default instructions for: opening the valve one or more times to fill the drum to a default whites maintenance phase liquid level, and operating the drum motor during a whites maintenance phase to cyclically rotate the drum according to a default whites cycle drum rotating schedule. The default whites maintenance phase liquid level is equal to or less than the default normal maintenance phase liquid level.

In some embodiments, the operating instructions further comprise instructions to receive a cycle modifier from the user interface, and modify at least one of the default normal cycle liquid level and the default whites cycle liquid level in response to receiving the cycle modifier.

In some embodiments, the default normal maintenance phase liquid level is 0.10% to 0.26% of a total interior volume of the drum.

In some embodiments, the default normal maintenance phase liquid level is 0.16% to 0.20% of the total interior volume of the drum.

In some embodiments, the default whites maintenance phase liquid level is 0.16% to 0.20% of the total interior volume of the drum.

In some embodiments, the whites laundry cycle program further comprises default instructions for operating the heater to obtain a target temperature in the liquid of at least 48° C. at an end of the whites maintenance phase.

In some embodiments, the whites laundry cycle program further comprises default instructions for operating the heater to obtain during at least 75% of the whites wash maintenance phase.

In some embodiments, the normal laundry cycle program further comprises respective default instructions for: draining the liquid from the tub during a normal dehydration phase, and operating the valve one or more times to fill the drum to a default normal rinse phase liquid level; and the whites laundry cycle program further comprises respective default instructions for: draining the liquid from the tub during a whites dehydration phase, and opening the valve one or more times to fill the drum to a default whites rinse phase liquid level, wherein the default whites rinse phase liquid level is greater than the default normal rinse phase liquid level. In some aspects of this embodiment, opening the valve one or more times to fill the drum to the default normal rinse phase liquid level comprises opening the valve to add 20 liters to 30 liters of water to the tub. In other aspects of this embodiment, opening the valve one or more times to fill the drum to the default normal rinse phase liquid level comprises opening the valve to add 23 liters to 27 liters of water to the tub. In other aspects of this embodiment, opening the valve one or more times to fill the drum to the default whites rinse phase liquid level comprises opening the valve to add 30 to 35 liters of water to the tub. In other aspects of this embodiment, opening the valve one or more times to fill the drum to the default normal rinse phase liquid level comprises opening the valve to add a first volume of water to the tub; opening the valve one or more times to fill the drum to the default whites rinse phase liquid level comprises opening the valve to add a second volume of water to the tub; and the second volume is 110% to 135% of the first volume of water. In other aspects of this embodiment, opening the valve one or more times to fill the drum to the default normal rinse phase liquid level comprises opening the valve to add a first volume of water to the tub; opening the valve one or more times to fill the drum to the default whites rinse phase liquid level comprises opening the valve to add a second volume of water to the tub; and the second volume is 130% of the first volume of water.

In some embodiments, the laundry washing machine further comprises a recirculation pump configured to pump liquid from the tub to a location in an upper half of the drum, and the whites laundry cycle program further comprises default instructions for operating the recirculation pump during regular intervals throughout the whites maintenance phase. In some aspects of this embodiment, the default instructions for operating the recirculation pump during regular intervals throughout the whites maintenance phase comprises instructions to operate the recirculation pump during at least 50% of the whites maintenance phase.

In other embodiments, the laundry washing machine further comprises a recirculation pump configured to pump liquid from the tub to a location in an upper half of the drum; the normal laundry cycle program further comprises instructions for operating the recirculation pump during 20% or less than the normal wash maintenance phase; and the whites laundry cycle program further comprises default instructions for operating the recirculation pump during at least 50% the whites maintenance phase.

In other embodiments, the normal maintenance phase has a first time duration; the normal whites maintenance phase has a second time duration; and the second time duration is at least twice as long as the first time duration.

In another exemplary aspect, there is provided a method for operating a laundry washing machine comprising: a cabinet; a tub mounted within the cabinet; a drum rotatably mounted within the tub; a drum motor configured to rotate the drum; a water supply; a valve selectively openable to direct water from the water supply to the tub; a heater; and a user interface configured to receive a laundry cycle selection. The method comprises: receiving the laundry cycle selection from the user interface; identifying the laundry cycle selection from a plurality of laundry cycle selection options including at least a normal laundry cycle and a whites laundry cycle; upon receiving a selection of the normal laundry cycle during a first operation of the laundry washing machine, executing a normal laundry cycle program comprising: opening the valve one or more times to fill the drum to a default normal maintenance phase liquid level, and operating the drum motor during a normal maintenance phase to cyclically rotate the drum according to a default normal cycle drum rotating schedule; and upon receiving a selection of the whites laundry cycle during a second operation of the laundry washing machine, executing a whites laundry cycle program comprising: opening the valve one or more times to fill the drum to a default whites maintenance phase liquid level, and operating the drum motor during a whites maintenance phase to cyclically rotate the drum according to a default whites cycle drum rotating schedule. The default whites maintenance phase liquid level is equal to or less than the default normal maintenance phase liquid level.

BRIEF DESCRIPTION OF THE DRAWINGS

Exemplary embodiments will now be described with reference to the attached Figures in which like references refer to like features.

DETAILED DESCRIPTION OF EXEMPLARY EMBODIMENTS

Various exemplary embodiments are described herein to illuminate the scope and meaning of the invention. However, these embodiments are all intended to be non-limiting examples of the subject matter as claimed.

Throughout this description and the appended claims, words used in the singular will be understood to include the plural, and vice-versa (e.g., a claim reciting a "a" feature is not limited to structures having only one such feature, unless expressly qualified as being "a single" feature, or using similar limiting language). Also, terms of position and location relative to a global reference frame, such as "above" and "below," are used to assist with describing the embodiments, however such terms are not intended to limit the embodiments or claims to structures having a particular global orientation. This description and the appended claims also refer to various physical measurements and dimensional properties. It will be understood that essentially all measurements are subject to ranges of error as a result of environmental conditions and typical variations in instrument precision, and all manufactured parts are subject to variations in dimension as a result of typical manufacturing tolerances. Thus, all dimensions and measurements used in herein will be understood to be approximate, but within a range of typical variations, as will be understood by persons of ordinary skill in the art in view of the disclosure herein.

The inventors have discovered that certain process variables of a laundry washing cycle can be modified, contrary to conventional wisdom and expectations, to provide greatly increased cleaning of white articles, as measured by industry-standard whiteness testing protocols. This discovery is illustrated by the following examples, which provide an example of conventional "normal" and "whites" cleaning cycles, and a non-limiting example of an improved whites cleaning cycle.

Figure 1:
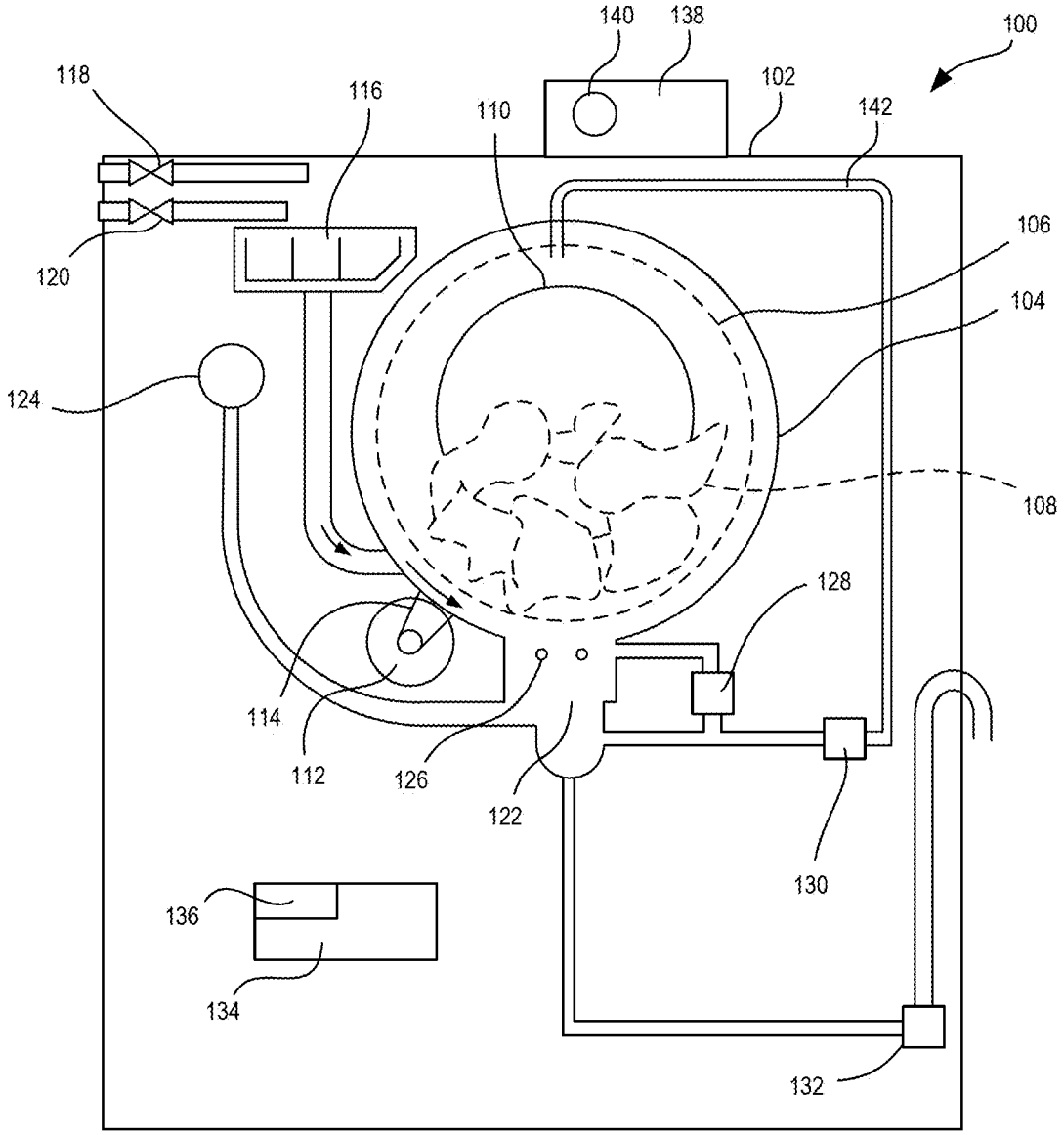
FIG. 1 is a schematic illustration of a laundry washing machine.

The following examples were performing using a laundry washing machine such as shown in FIG. 1. The washing machine 100 generally includes a cabinet 102 that contains a washing tub 104 and a drum 106 rotatably mounted within the tub 104. The drum 106 is generally cylindrical, and has a perforated cylindrical wall to allow liquid and soil to pass through it. The drum 106 is configured to receive laundry 108 via an openable door 110 in the front of the cabinet 102. The drum 106 is connected to a drum motor 112, either directly or by a belt 114 or other drive transmission (e.g., gears, direct drive, etc.).

A cleaning dispenser 116 is provided to receive detergent, bleach, softener, or other treatment chemicals from a user or an automatic dispensing system. The machine 100 is connected to cold and hot water supplies by a cold water valve 118 and a hot water valve 120, respectively. The valves 118, 120 may be operated to introduce cold and hot water to the tub 104 either directly, or via the dispenser 116.

The bottom of the tub 104 has a depressed sump area 122 to receive some or all of the water and/or treating chemistry (which for brevity, is referred to simply as "liquid"). A level sensor 124 is connected to the tub 104 at the sump 122 to determine the level of liquid within the tub 104 (the drum 106 is within the tub 104, and liquid passes freely through the drum wall, so reference to liquid level in the tub 104 includes any liquid that is also within the drum 106).

The sump 122 includes a heater 126, such as resistance-type electrical heater, that is operable to heat the liquid. The machine 100 also includes a mixing pump 128, which is configured to pull liquid out of the sump 122 and pump it back into the sump 122 or tub 104 to mix the liquid and help homogenize the mixture of water and cleaning chemicals. A recirculation pump 130 is provided to pull liquid from the sump 122, and distribute it onto the laundry 108 within the drum 106, such as via a recirculation passage 142 that terminates in the upper half of the drum 106 to direct the incoming liquid generally onto the laundry. A drain pump 132 is also fluidly connected to the sump 122, and configured to pump liquid from the sump 122 to a drain (not shown) located outside the machine 100.

A control system 134 is provided to control the operation of the machine 100. The control system 134 is electrically connected to the drum motor 112, valves, 118, 120, liquid level sensor 124, heater 126, pumps 128, 130, 132, a user interface 138, and potentially other operating mechanisms and sensors, as known in the art. The control system 134 has a processor that reads and executes operating programs stored in an associated non-volatile memory 136, to thereby perform cleaning programs. The user interface 138 includes one or inputs 140, such as buttons, switches, dials and the like, and may include one or more outputs, such as lights and audio signals.

The machine 100 is configured to operate various different cleaning programs, each of which requires a particular control sequence for the various working parts. Such cleaning programs typically have a default setting, and may also allow the user to change various operating variables. For example, a "normal" setting may have default water temperature and water level settings, which may be modified by the user. Other programs may not have adjustable settings.

The user interface 138 is operatively connected to the control system 134 to allow a user to select and start one or more laundry cycles, such as a normal cycle (i.e., a general default cycle), a colored fabric cycle, a delicate cycle, a steam cycle, a sanitary cycle, a whites cycle, and so on. In use, the operator selects one of the available cycles, and may also select cycle modifiers, such as load size, cleaning intensity/soil level, and so on. The user interface 138 also may allow other selections, such as selections to indicate that bleach should be used, additional rinse cycles should be run, and so on. The control system 134 receives the user inputs, determines how to operate the various parts of the machine 100 to perform the selected cycle and modifiers (if any) such as by using lookup tables and/or algorithms, and the operates the machine to perform the selected program.

Figure 2:
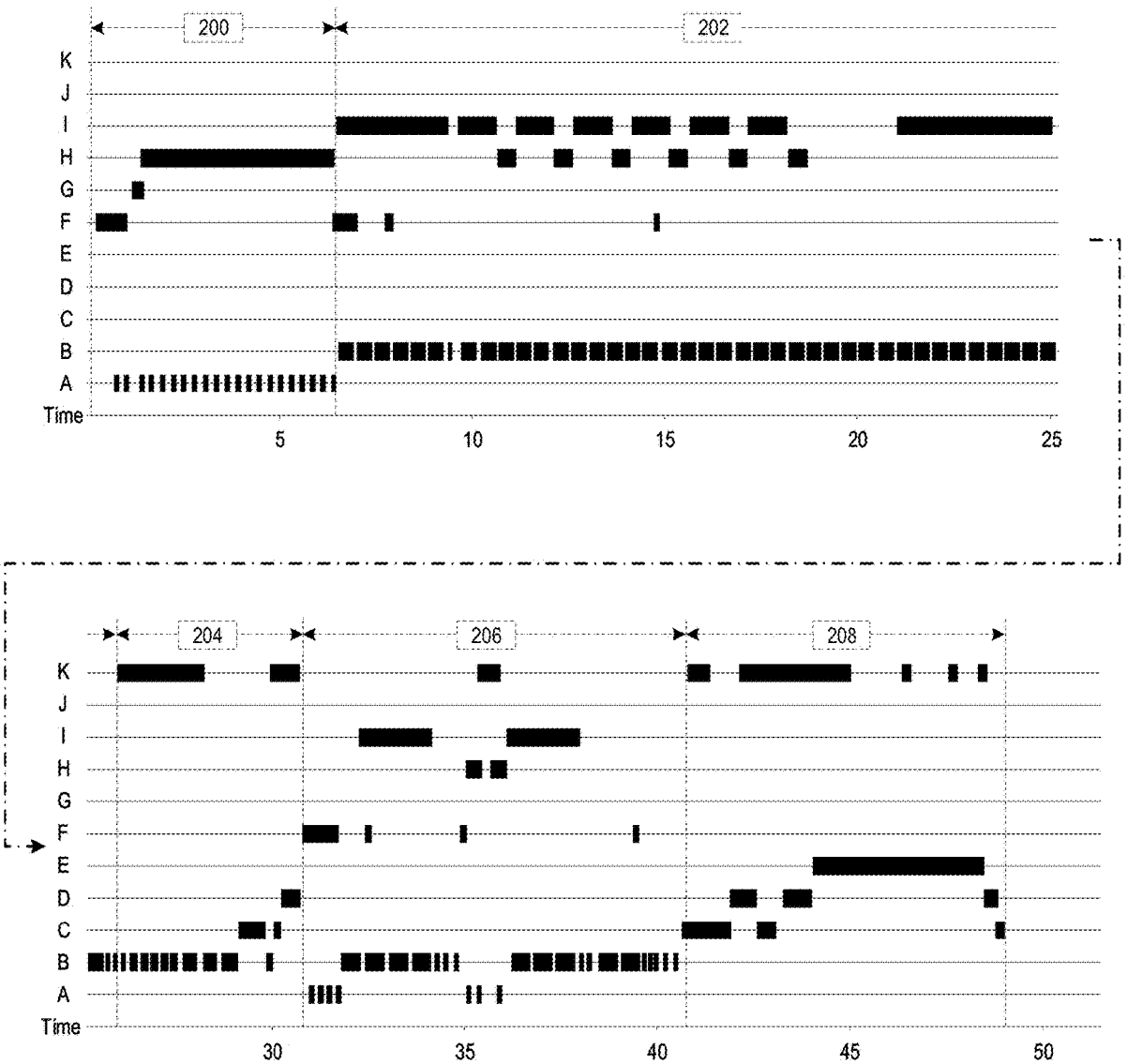
FIG. 2 is a process diagram for a conventional normal cleaning cycle.
Figure 3:
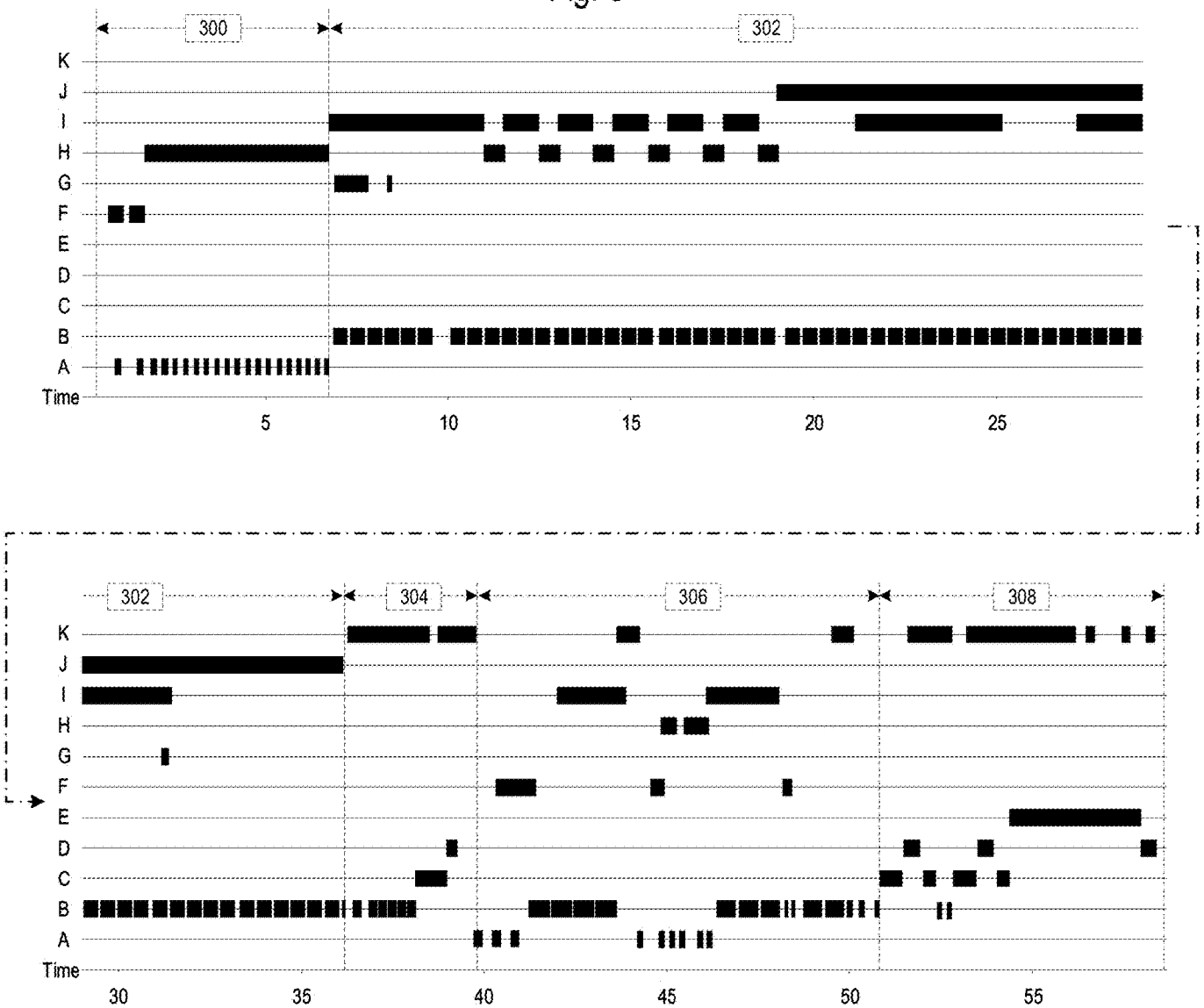
FIG. 3 is a process diagram for a conventional whites cleaning cycle.
Figure 4:
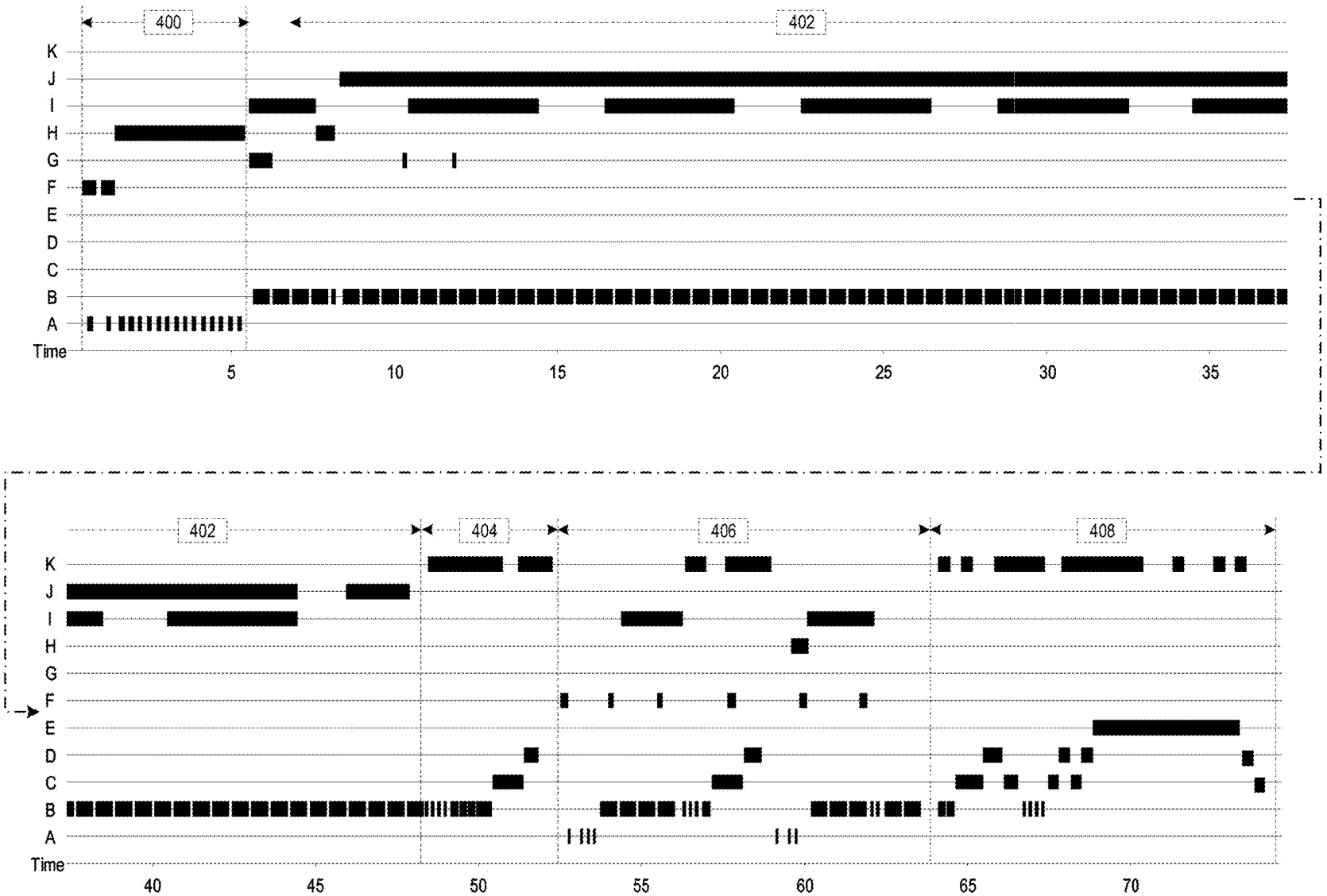
FIG. 4 is a process diagram for an improved whites cleaning cycle.

The following examples illustrate how certain modifications to the control variables can yield an unexpected improvement in cleaning white laundry. Specifically, three different operating cycles were performed using standardized testing methods and samples, to develop data demonstrating cleaning effectiveness. FIGS. 2-4 illustrate process charts for the three different operating cycles. FIG. 2 shows a conventional "Normal" cleaning cycle intended for general laundry cleaning (hereafter, the "Normal" cycle). FIG. 3 shows a conventional "Whites" cleaning cycle intended for cleaning white laundry items (hereafter, the "conventional whites" cycle). FIG. 4 shows an example of an improved "Whites" cleaning cycle demonstrating a surprisingly significant improvement over the conventional whites cleaning cycle (hereafter, the "improved whites" cycle). All three cycles were performed using essentially identical laundry washing machines.

In each case, the laundry washing machine 100 had a drum diameter of 565 millimeters (22.25 inches), a drum tilt axis of 4 degrees, and a drum capacity of 127 liters (4.5 cubic feet). It is expected that machines 100 having different drum dimensions can obtain results comparable to the following examples upon appropriate scaling of the operating variables (e.g., liquid fill levels).

The test data (see FIG. 5) was developed using conventional and standardized test methods for evaluating the cleaning performance of a laundry washing machine. The effectiveness of white cleaning cycles typically is measured according to industry guidelines. In particular, the Association of Home Appliance Manufacturers (AHAM) has established standard number AHAM HLW-1-2013 "Performance Evaluation Procedures for Household Clothes Washers," which can be used to provide an objective measure of how much a wash article darkens over the course of multiple wash cycles. Details of this test, including the test procedures, equipment and materials, are available from AHAM.

For these tests, each laundry cycle was conducted with four monitors, four SBL 2004 soil ballasts, and other wash articles to simulate a full load of laundry. The monitors were used to determine darkening of a standard fabric, and the soil ballasts were used to introduce a standardized load of soil to the laundry load. Each monitor was secured to a towel with a safety pin, and items were loaded into the machine according to the 8 pound loading procedure set forth in AHAM HLW-1-2013. Specifically, the items and their loading used in each cycle are shown in Table 1.

TABLE 1

| Material | No. of Items | Details |
|---|---|---|
| Pillowcase | 1 | Tented, laying across the axis, point to right |
| SBL 2004 (#1) | 1 | Laid flat across the axis |
| Towel | 3 | Tented, point to back, point to front, point to back |
| Towel | 1 | Folded in half lengthwise, laid flat fold to front |
| Monitor | 1 | Laid flat across the axis |

TABLE 1-continued

| Material | No. of Items | Details |
|---|---|---|
| Sheet | 1 | Tented, placed in a "Z" formation across axis, point to left |
| SBL 2004 (#2) | 1 | Laid flat across the axis |
| Pillowcase | 1 | Tented, laying across the axis, point to left |
| Towel | 1 | Folded in half lengthwise, laid flat fold to front |
| Monitor | 1 | Laid flat across the axis |
| Towel | 3 | Tented, point to front, point to back, point to front |
| Towel | 3 | Tented, point to back, point to front, point to back |
| Towel | 1 | Folded in half lengthwise, laid flat fold to front |
| Monitor | 1 | Laid flat across the axis |
| Pillowcase | 1 | Tented, laying across the axis, point to right |
| SBL 2004 (#3) | 1 | Laid flat across the axis |
| Sheet | 1 | Tented, placed in a "Z" formation across axis, point to left |
| Towel | 1 | Folded in half lengthwise, laid flat fold to front |
| Monitor | 1 | Laid flat across the axis |
| Towel | 3 | Tented, point to front, point to back, point to front |
| SBL 2004 (#4) | 1 | Laid flat across the axis |
| Pillowcase | 1 | Tented, laying across the axis, point to left |

The monitors were type PCN-1 (w3x) 20×20 centimeter white 65%/35% polyester/cotton woven fabric strips. Before testing, the monitors were washed three times with optical brightener containing detergent in the amount of 185 grams per square meter of monitor. The soil ballasts were type SBL 2004 fabric swatches infused with a predetermined composition of soil materials, including a bleach consuming agent and 8 grams of soil per swatch. The monitors, soil ballasts and pre-testing detergent were standard samples supplied by the Center for Test materials in Rotterdam, Netherlands. The monitors were reused between test cycles to provide a progressive evaluation of whiteness, but new soil ballasts were used for each test cycle.

In each case, the test machine was prepared according to AHAM HLW-1-2013, sections 4.5, 4.6 and 4.7 regarding the water conditions, electricity supply and detergent for testing.

Figure 5:
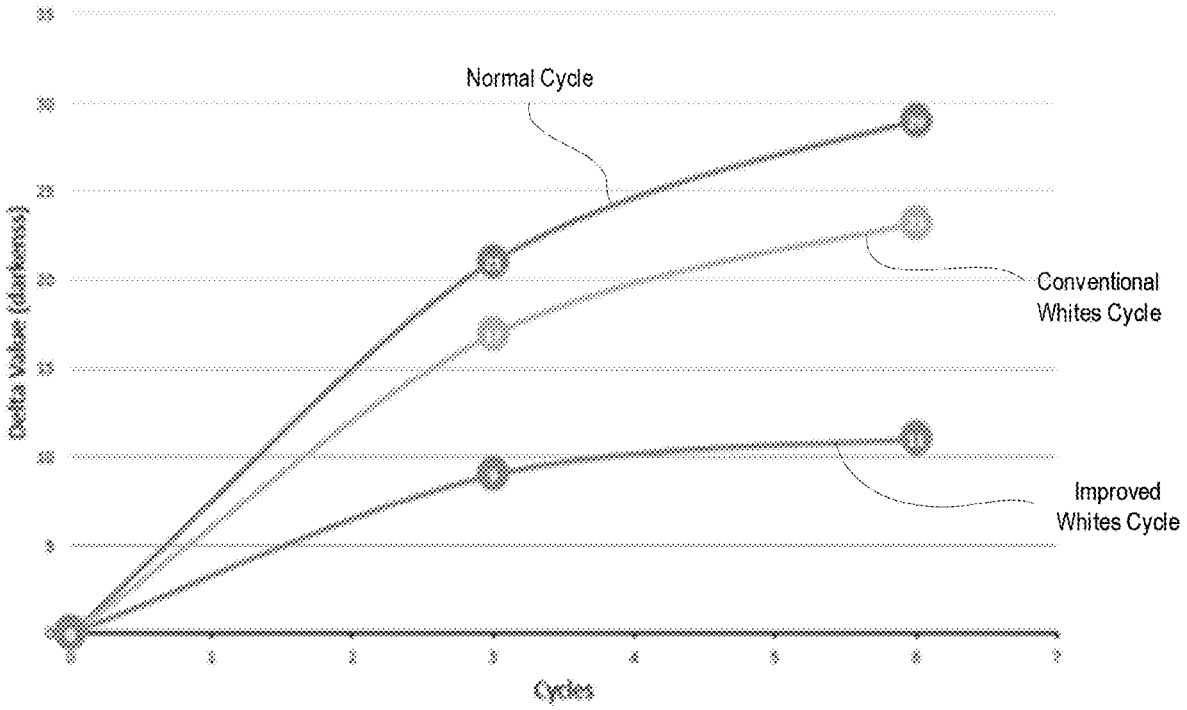
FIG. 5 is a comparative data plot indicating changes in fabric darkness over the course of multiple washing cycles.
Figure 6:
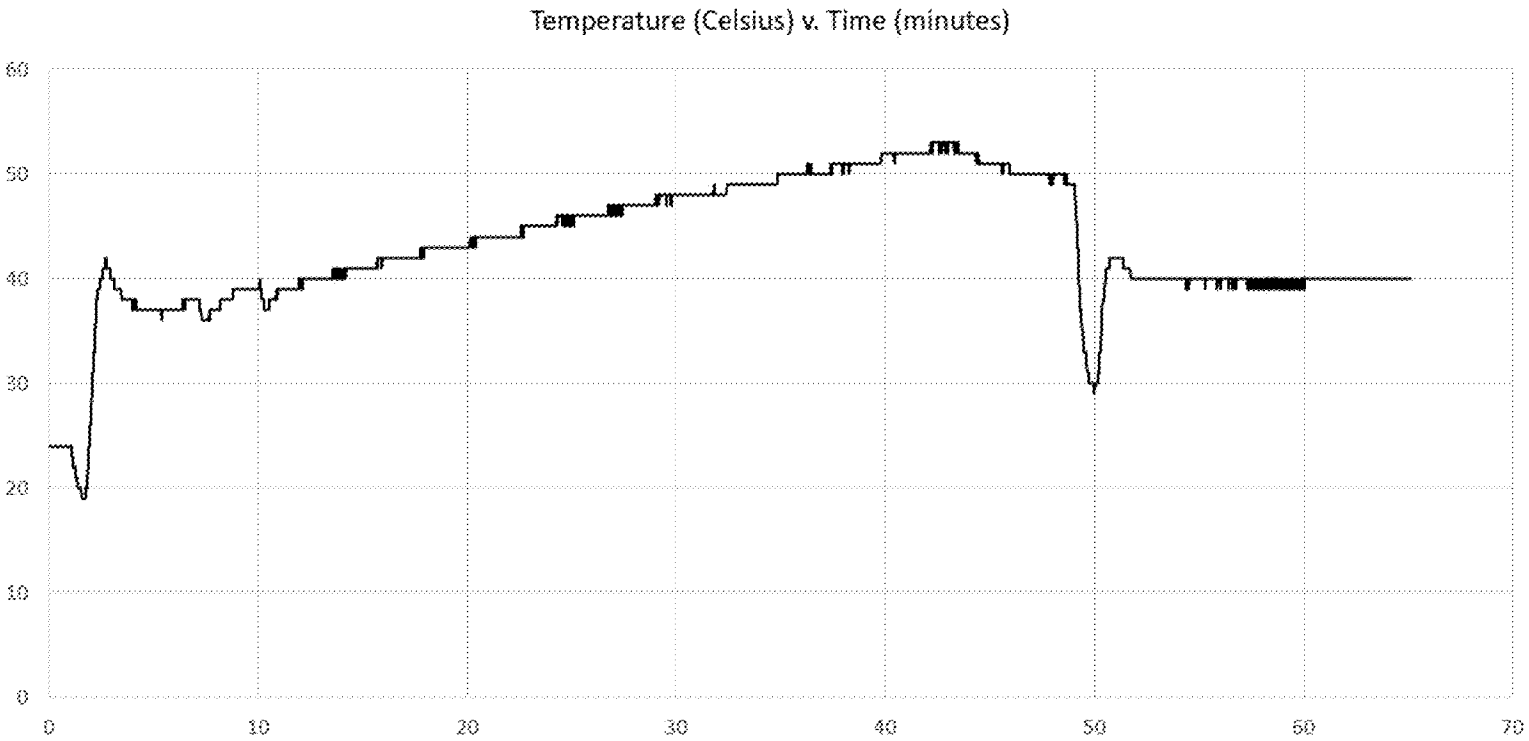
FIG. 6 is a temperature (ordinate) vs. time (abscissa) plot for an improved whites cleaning cycle.

The monitors were tested via optical scanning using a spectrophotometer to determine reflectance of the fabric, according to the methods in AHAM HLW-1-2013 Section 6.6.8. Specifically, each monitor was scanned at four locations to obtain an average reflectance score. Each monitor was evaluated before the first the test cycle to establish a baseline reflectance value, and tested again after the third wash cycle and the sixth wash cycle. The monitors were covered or kept in a dark room to air dry before testing or between cycles, to protect them from ultraviolet light. As a general matter, the monitors lose reflectance after each wash cycle—making them darker after each cycle. The "darkness" score indicated in FIG. 5 is a measure of the reduction in reflectance as compared to the original baseline reflectance values. Specifically, after each cycle, the monitors were tested, and the baseline reflectance value was subtracted from the current reflectance value to obtain the darkness score for that cycle.

FIGS. 2-4 illustrate process charts for the three different operating cycles. Each process chart identifies the activation times (in minutes) for each of the following operating parameters:

A. Slow Tumbling: motor 112 driving drum 106 with bidirectional rotation with a mean drum rotation speed of about 25-30 rotations per minute ("rpm") during each motion.

B. Normal Tumbling: motor 112 driving drum 106 with bidirectional rotation with a mean drum rotation speed of about 48 rpm.

C. Low Speed Spin: motor 112 driving drum 106 with unidirectional rotation with a mean drum rotation speed of about 115-150 rpm.

D. High Speed Spin: motor 112 driving drum 106 with unidirectional rotation with a mean drum rotation speed of about 600 rpm.

E. Final Spin: motor 112 driving drum 106 with unidirectional rotation with a mean drum rotation speed of about 1,050 rpm.

F. Cold Water Add: cold water valve 118 open.

G. Hot Water Add: hot water valve 120 open.

H. Mix: mixing pump 128 operating.

I. Recirculate: recirculation pump 130 operating.

J. Heat: heater 126 operating.

K. Drain: drain pump 132 operating.

Note that certain universal process steps that are expected to have no bearing on the test results are not shown in the examples. For example, all cycles operate the drain pump at time zero to make sure the tub 104 is clear before staring the cycle.

Referring specifically to FIG. 2, the "normal" cycle generally includes a loading phase 200, a wash maintenance phase 202, a dehydration phase 204, a rinse phase 206, and a final spin phase 208.

During loading 200, cold water and about 1.98 liters of hot water are delivered to the tub 104 via the valves 118, 120 and distributor 116. The laundry 108 is tumbled by driving the drum 106 back and forth at an oscillation frequency of about 3.0 reversals per minute, and a rotation speed of about 25-30 rpm during each motion. At the same time, the mixing pump 128 is operated to homogenize the liquid within the sump 122.

The wash maintenance phase 202 begins when the drum 106 begins rotating during its normal, generally continuous, washing speed and frequency. The wash maintenance phase begins with adding additional cold water to raise the liquid level (by then, much of the liquid added in the loading cycle 200 is absorbed in the laundry 108, thus lowering the free liquid level). The total amount of cold water added during the loading phase 200 and wash maintenance phase is about 14.40 liters. During wash maintenance 202, the drum 106 is rotated back and forth at a frequency of about 2.1 reversals per minute, and a rotation speed of approximately 48 rpm during each motion. During wash maintenance 202, the recirculation pump 130 is periodically operated to deliver wash liquid to the top of the laundry 108. The mixing pump 128 is also periodically operated, and cold water is added at intervals.

The dehydration phase 204 begins by operating the drain pump 132 while continuing to oscillate the drum 106 at essentially the same frequency and rotation speed as during wash maintenance 202. The dehydration phase 204 then proceeds to a low speed spin, and then a high speed spin. The drain pump 132 is operated during the high speed spin, and the combination of spinning and pumping extracts a bulk of the bound water from the laundry 108 and removes it from the machine 100.

The rinse phase 206 begins by adding about 13.15 liters of cold water to the tub 104, while gently tumbling the laundry 108 such as done during the initial loading phase 200. About 11.79 liters of additional cold water are added during the rinse phase 206. The rinse phase 206 then transitions to more rapid tumbling in a manner similar to the wash maintenance phase 202, and operating the recirculation pump 130 to distribute water to the top of the laundry 108. Approximately halfway through the rinse phase 206, a short intermediate sequence is performed by reducing the tumbling speed and operating the drain pump 132 and the mixing pump 128, then returning to more rapid tumbling and operating the recirculation pump 130.

The final spin phase 208 is performed by operating the drain pump 132 and driving the drum 106 at a series of low speed spins, high speed spins, and then the final spin speed. The normal cycle concludes at the end of the final spin phase 208.

Referring now to FIG. 3, the "conventional whites" cycle generally includes a loading phase 300, a wash maintenance phase 302, a dehydration phase 304, a rinse phase 306, and a final spin phase 308.

At the beginning of the loading cycle 300, about 6.87 liters of cold water is delivered to the tub 104 via the distributor 116. The laundry 108 is tumbled by driving the drum 106 back and forth at an oscillation frequency of about 3.6 reversals per minute, and a rotation speed of about 25-30 rpm during each motion. At the same time, the mixing pump 128 is operated to homogenize the liquid within the sump 122.

The wash maintenance phase 302 begins by adding about 10.65 liters of hot water to the tub 104. The hot water raises the temperature of the liquid in the tub 104 from about 19° C. (about 66° F.) to about 39° C. (about 102° F.) within about 70 seconds. As with the normal cycle, during wash maintenance 302, the drum 106 is rotated back and forth at a frequency of about 2.1 reversals per minute, and a rotation speed of approximately 48 rpm during each motion. During wash maintenance 302, the recirculation pump 130 is periodically operated to deliver wash liquid to the top of the laundry 108. The mixing pump 128 is also periodically operated. In addition, the heater 126 is operated for approximately 17 minutes at the end of the wash maintenance phase 302. During operation of the heater 126, the temperature of the liquid in the tub 104 rises from about 34° C. (about 93° F.) to about 45° C. (about 113° F.).

The dehydration phase 304 begins by operating the drain pump 132 while continuing to oscillate the drum 106 at essentially the same frequency and rotation speed as during wash maintenance 302. The dehydration phase 304 then proceeds to a low speed spin, and then a high speed spin. The drain pump 132 is operated during the high speed spin, and the combination of spinning and pumping extracts a bulk of the bound water from the laundry 108 and removes it from the machine 100.

The rinse phase 306 begins by adding about 14.35 liters of cold water to the tub 104, while gently tumbling the laundry 108 such as done during the initial loading phase 300. The rinse phase 306 then transitions to more rapid tumbling in a manner similar to the wash maintenance phase 302, and operating the recirculation pump 130 to distribute water to the top of the laundry 108. About 18.97 liters of water are added during the course of the rinse phase, yielding a total amount of about 33.4 liters of cold rinse water. Approximately halfway through the rinse phase 306, a short intermediate sequence is performed by reducing the tumbling speed and operating the drain pump 132 and the mixing pump 128, then returning to more rapid tumbling and operating the recirculation pump 130.

The final spin phase 308 is performed by operating the drain pump 132 and driving the drum 106 at a series of low speed spins, high speed spins, and then the final spin speed. The conventional whites cycle concludes at the end of the final spin phase 308.

FIG. 4 shows an example of an "improved whites" cycle. The improved whites cycle generally includes a loading phase 400, a wash maintenance phase 402, a dehydration phase 404, a rinse phase 406, and a final spin phase 408.

At the beginning of the loading cycle 400, about 7.09 liters of cold water is delivered to the tub 104 via the distributor 116. The laundry 108 is tumbled by driving the drum 106 back and forth at an oscillation frequency of about 3.6 reversals per minute, and a rotation speed of about 25-30 rpm during each motion. At the same time, the mixing pump 128 is operated to homogenize the liquid within the sump 122.

The wash maintenance phase 402 begins by adding about 9.10 liters of hot water to the tub 104. The hot water raises the temperature of the liquid in the tub 104 from about 19° C. (about 66° F.) to about 39° C. (about 102° F.) within about 60 seconds. The drum 106 is rotated back and forth at a frequency of about 1.67 reversals per minute, and a rotation speed of approximately 48 rpm during each motion. During wash maintenance 402, the recirculation pump 130 is periodically operated to deliver wash liquid to the top of the laundry 108. Unlike the conventional whites cycle, the mixing pump 128 is not operated during wash maintenance 402. The heater 126 is operated for about 38 minutes starting about approximately 2.5 minutes into the wash maintenance phase 402. During operation of the heater 126, the temperature of the liquid in the tub 104 rises from about 38° C. (about 100° F.) to about 51° C. (about 124° F.). FIG. 5 shows a plot of the water temperature in the tub during a typical operation of the improved whites cycle.

The dehydration phase 404 begins by operating the drain pump 132 while continuing to oscillate the drum 106 at essentially the same frequency and rotation speed as during wash maintenance 302. The dehydration phase 404 then proceeds to a low speed spin, and then a high speed spin. The drain pump 132 is operated throughout most of the dehydration phase 404, and the combination of spinning and pumping extracts a bulk of the bound water from the laundry 108 and removes it from the machine 100.

The rinse phase 406 begins by adding about 13.03 liters of cold water to the tub 104, while gently tumbling the laundry 108 such as done during the initial loading phase 400, then transitioning to more rapid tumbling in a manner similar to the wash maintenance phase 402. About 19.57 liters of additional cold water are added during the rinse phase 406. Approximately halfway through the rinse phase 406, a short intermediate sequence is performed by rotating the drum 106 at a low speed spin and then a high speed spin, while operating the drain pump 132. The recirculation pump 130 is operated twice to distribute water to the top of the laundry 108; once before the intermediate sequence, and once after. Cold water is added periodically throughout the rinse phase 406. The mixing pump 128 is also operated once, after the intermediate sequence.

The final spin phase 408 is performed by operating the drain pump 132 and driving the drum 106 at a series of low speed spins, high speed spins, and then the final spin speed. The improved whites cycle concludes at the end of the final spin phase 408.

In each of the foregoing examples, the quantity of water added can be regulated by a flowmeter, by feedback control using a water level sensor 124, by timed operation of calibrated valves, and so on. The total amount of water, and the times at which it is added, also may be regulated by other feedback control systems. For example, one or both of the water valves 118, 120 may be operated by opening the valve at a predetermined time, and closing the valve when a predetermined water level is measured using the water level sensor 124. The machine 100 also may be programmed to actively monitor water level, and add more water as may be necessary to maintain the water at a predetermined level or within a predetermined range of levels. For example, the foregoing conventional whites cycle and improved whites cycle may be programmed to maintain the free water level (i.e., the portion that is not absorbed into the laundry) at predetermined ranges at specific times during the cycle. Other alternatives and variations will be apparent to persons of ordinary skill in the art in view of the present disclosure.

It will be appreciated from the above description and FIGS. 3 and 4 that the conventional whites cycle and the improved whites cycle differ in several respects. Certain differences are expected to lead to somewhat improved washing results, while other differences would, under conventional thought, be expected to lead to reduced cleaning performance for the improved white cycle.

Changes that would be expected to lead to somewhat improved cleaning in the improved whites cycle include the longer duration of the wash maintenance phase 402 and the higher final wash temperature. The extra spinning process performed during the rinse cycle also might expected to improve cleaning performance by some small degree. Also, differences in the frequency and duration of recirculation during the two wash maintenance phases 302 and 402 would not be expected to have a significant effect on cleaning performance, but potentially could affect the final results to some degree.

In contrast, the reduced water level in the improved whites cycle wash maintenance phase 402 would be expected to provide reduced cleaning performance as compared to the larger volume used in the conventional whites cycle maintenance phase 302. Such reduction in cleaning performance would be expected for several reasons. First, the lower liquid volume reduces the mobility of the laundry 108 within the drum 106, thereby reducing laundry movement and inhibiting uniform exposure of the laundry 108 to the cleaning chemistry. This would be expected to reduce the ability of the wash liquid to remove soil from the laundry 108. And, and perhaps more importantly, the reduced liquid volume would be less effective at preventing redepositing of removed soil back onto the laundry 108. In particular, any soil that is removed would be expected to remain in close proximity to the laundry 108, thus increasing the likelihood of being redeposited on the laundry 108.

The reduction in water level during wash maintenance takes two forms. First, is a change in total liquid volume used throughout the maintenance phase, and second is a change in working volume at any given time during the maintenance phase. In the improved whites cycle described above, both values are reduced as compared to the conventional whites cycle.

Regarding the total wash liquid volume, the conventional whites cycle is programmed to add a total of about 17.52 liters of water during the loading phase 300 and wash maintenance phase 302 (note that the water added in the loading phase 300 contributes to the total volume used in the wash maintenance phase 302), whereas the improved whites cycle is programmed to add only about 16.19 liters of water during the loading phase 400 and wash maintenance phase 402. This is a reduction of about 7.5% in total wash water volume. This reduced total volume would be expected to have at least some detrimental effect on cleaning performance.

Perhaps more importantly, the improved white cycle also uses a significantly lower working liquid volume in the wash maintenance phase 402, as compared to the conventional whites cycle. The "working" volume is the volume of liquid within the drum 106 at any given time. The remaining volume of liquid (the "reserve" volume) is distributed throughout other parts of the machine 100, such as the sump 122, fluid lines, pumps, and so on. Because the drum 106 is generally above those other parts, any change in the wash liquid volume is experienced primarily at the drum 106 as a change in the working volume.

In the examples above, the conventional whites cycle and improved whites cycle use similar algorithms to maintain the working volume of the wash liquid during the wash maintenance phase 302, 402, but the improved whites cycle maintains a significantly lower working volume than the conventional whites cycle. More specifically, the conventional whites cycle is programmed to use feedback from the water level sensor 124 to fill the drum 106 to a height of 34 millimeters (1.34 inches) from the lowest point within the drum 106, and then add additional water to maintain the 34 millimeter water level at periodic intervals and/or whenever the water level drops below a lower setpoint value. This yields a maximum working volume of approximately 1.00 liter (0.035 cubic feet) for the conventional whites cycle. This working volume is about 0.78% of the total drum volume.

In contrast, the improved whites cycle is programmed to use feedback from the water level sensor 124 to fill the drum 106 to a height of 19 millimeters (0.75 inches) from the lowest point within the drum 106, and maintain this water level by adding water at periodic time intervals and/or when the level drops below a lower setpoint value (other embodiments may use other control systems or algorithms to maintain the working level). This results in a maximum working volume of approximately 0.23 liters (0.0081 cubic feet). This working volume is about 0.18% of the total drum volume.

Thus, the improved whites cycle has a maximum working volume that is approximately 23% of the conventional whites cycle working volume—i.e., a 77% reduction in maximum working volume. This 77% reduction in working volume would be expected, using conventional thought, to lead to greatly reduced cleaning performance because there is much less liquid to contact the laundry to remove soil, and any soil that is removed would remain in close proximity to the laundry 108 to allow redepositing on the laundry 108.

Another change that would be expected to yield reduced cleaning performance is the reduction in total rinse water volume. The conventional whites cycle uses a total of about 33.32 liters of rinse water, whereas the improved whites cycle uses a total of about 32.60 liters of rinse water, which is a reduction of about 2%. The rinse water removes residual wash liquid and soil, and conventional wisdom states that reducing rinse water volume would lead to reduce cleaning performance. If the reduction in rinse volume were the only difference between the conventional whites cycle and the improved whites cycle, this change would be expected to at least slightly decrease cleaning performance. However, the improved whites cycle also uses significantly less cleaning liquid, and therefore the laundry 108 would be expected to have a higher amount of redeposited soil at the beginning of the rinse cycle, and therefore adding a lower volume of rinse liquid would be expected to more significantly exacerbate the problem caused by using less wash liquid volume.

Viewing the improved whites cycle as a whole, the reductions in total and working liquid volume during the wash maintenance phase, as well as the reduced rinse liquid volume, would be expected to reduce the cleaning performance, and it would not be expected that the changes to wash liquid temperature and wash duration would overcome, or at least not significantly overcome, the reduced performance.

Despite expectations to the contrary, it has been found that the improved whites cycle provides greatly increased cleaning performance. In fact, the improved whites cycle is more than twice as effective than the conventional whites cycle, as compared to the normal cycle. FIG. 5 illustrates the improved performance. FIG. 5 is a plot of change in whiteness—or more specifically, increasing darkness—of test samples obtained using the normal cycle, the conventional whites cycle, and the improved whites cycle. The x-axis indicates the number of test cycles, and the y-axis indicates the comparative change in darkness of the sample from one cycle to the next. As shown in the plot, test samples washed six times with the conventional whites cycle experienced an increase in darkness of about 23. In contrast, test samples washed six times with the improved whites cycle experienced an increase in darkness of only about 11. Thus, fabrics washed with the improved whites cycle lose about half of their initial "whiteness" as compared to those washed with the conventional whites cycle.

The difference is even more dramatic when compared to the results of the normal cycle. Fabrics cleaned with the normal cycle have an average differential darkness of 29 after six cycles. The conventional whites cycle yields a darkness of 23, which is only 6 less than the normal cycle. In contrast, the improved whites cycle yields a darkness of 11, which is 18 less than the normal cycle. Thus, as compared to the normal cycle, the improved whites cycle is three times better than the conventional whites cycle at maintaining the whiteness of the fabric.

The difference in results between the normal cycle and the improved whites cycle is particularly unexpected, because the improved whites cycle actually adds approximately the same amount as, or less, water during the loading and initial maintenance phase than the normal cycle. This is in contrast to adding more water in the conventional whites cycle, and contrary to conventional wisdom that suggests that more water is preferable for a whites cleaning cycle.

Table 1 illustrates various differences between the three cycles.

TABLE 1

(approximate values)

| | Normal | Conventional whites | Improved whites |
|---|---|---|---|
| Initial maintenance water volume (liters) | 16.38 | 17.52 | 16.19 |
| Working volume as % of drum volume | 0.18% | 0.78% | 0.18% |
| Maintenance target temp | n/a | 45° C. | 50-52° C. |
| Rinse volume (liters) | 24.94 | 35.32 | 32.60 |

Certain relationships between the foregoing and other operating differences are expected to lead to at least some of the improved cleaning results of an improved whites cycle as compared to a normal cycle.

First, operating the improved whites cycle at a working volume percentage that is approximately equal to or less than the normal cycle, in combination with actively heating the water during the maintenance phase (e.g., to a target temperature of about 45° C. and more preferably about 50° C.) and using a greater rinse volume, is expected to yield surprisingly improved cleaning performance. Regarding the rinse volume, it is expected, based on the foregoing, that improved results will be obtained by limiting the total rinse water volume to about 110% to about 135% of the normal rinse water volume, or more preferably to about 130% of the total rinse water volume (i.e., 30.60 liters vs. 24.94 liters). Of course, this will also reduce water waste and the associated costs.

Various embodiments also may include other specific comparative operating parameters to aid with improving cleaning performance. For example, the duration of the improved whites wash maintenance phase 402 (i.e., between beginning normal sustained tumbling and initiating drain pump operation to evacuate the drum of water) may be approximately 200% or more of the duration of the normal wash maintenance phase 202. As another example, the mixing pump 128 (if provided) may be operated during about 30% to about 60% of the improved whites wash maintenance phase 402, but only operated during about 20% or less of the normal wash maintenance phase 202. Also, the improved whites cycle may include operating the heater 126 for at least about 75% and more preferably at least about 85% of the wash maintenance phase 402. Similarly, the improved white cycle may include operating the heater 126 to obtain a final wash temperature of at least 48° C. and more preferably at least 50° C. Combinations of the foregoing can also be used to beneficial effect.

The appended claims include other combinations of operating parameters that are expected, based on the disclosures herein, to provide other improved whites cleaning cycles as compared to conventional cycles. It will be understood that the claims define part of this written description, and are incorporated herein as further definitions of embodiments of the invention.

Without being bound to any particular theory of operation, it is believed that this remarkable improvement in maintaining the whiteness of laundry is primarily a result of the counter-intuitive decision to reduce the total volume of liquid used in the initial wash loading and wash maintenance phases of operation, and reduce the working volume during the wash maintenance phase (the reduced volume of rinse liquid would also be expected to exacerbate the problems caused by the reduce wash liquid volume). As indicated above, one would expect that reducing the total and working wash liquid volumes would lead to reduced cleaning effectiveness due to a reduced ability to remove soil from the laundry, and the greater likelihood of redepositing removed soil back onto the laundry.

It is also believed that this remarkable improvement is not simply the result of increasing the duration or temperature of the wash maintenance phase. Such changes are relatively conventional and well-understood in the art, and would be expected to provide nominal improvements, rather than the substantial improvement found by the inventors. Thus, while these changes could help provide improved results, they do not account for the surprising magnitude of the improvement.

While the foregoing example provides one embodiment of a greatly improved whites cleaning cycle, other embodiments may modify the operating parameters in various ways while still obtaining similar results. For example, it is expected that improved cleaning performance can be obtained by scaling the values described above as a function of drum volume, load size selection, cleaning intensity selection, and so on. For example, in the foregoing improved whites cycle, the maximum working volume equals about 0.18% of the total volume of the drum 106, and machines having smaller or larger drum volumes may use a similar relative maximum working volume to obtain similar results. It is also expected that somewhat larger or smaller working volumes would provide similar improved cleaning results. For example, the maximum working volume may be about 0.16% to about 0.20% of the total drum volume, or 0.10% to about 0.30% of the total drum volume.

The benefits of the discoveries described herein can be obtained using various commercial embodiments. For example, a typical laundry washing machine 100 is programmed to perform various different cleaning cycles, such as "normal," "colors," "heavy soil," "light soil," "speed wash," and "whites." Such machines can be improved by programming the "whites" cycle to use a significantly reduced total and/or working liquid volume during the wash maintenance phase. For example, the whites cycle may be programmed to have a maximum working volume of about 0.30% or less of the total drum volume. Such programming also may be coupled with a default load size setting. For example, the machine 100 may also include options to select a "small," "normal" or "large" load size, and the whites cycle may be programmed to have a maximum working volume of about 0.30% or less of the total drum volume for the "normal" load size. Other alternatives and variations will be apparent to persons of ordinary skill in the art in view of the present disclosure.

The invention claimed is:

1. A laundry washing machine comprising:
- a cabinet;
- a tub mounted within the cabinet;
- a drum rotatably mounted within the tub;
- a drum motor configured to rotate the drum;
- a water supply;
- a valve selectively openable to direct water from the water supply to the tub;
- a heater;
- a user interface configured to receive a laundry cycle selection; and
- a control system comprising a processor and a memory storing operating instructions in a non-volatile memory, the operating instructions comprising instructions to:
  - receive the laundry cycle selection from the user interface;
  - identify the laundry cycle selection from a plurality of laundry cycle selection options including at least a normal laundry cycle and a whites laundry cycle;
  - upon receiving a selection of the normal laundry cycle, automatically execute a predefined normal laundry cycle program comprising respective default instructions for:
    - opening the valve one or more times to fill the drum to a preset normal maintenance phase liquid level stored in the memory, and
    - operating the drum motor during a normal maintenance phase to cyclically rotate the drum according to a preset normal cycle drum rotating schedule; and
  - upon receiving a selection of the whites laundry cycle, automatically execute a predefined whites laundry cycle program comprising respective default instructions for:
    - opening the valve one or more times to fill the drum to a preset whites maintenance phase liquid level stored in the memory, and
    - operating the drum motor during a whites maintenance phase to cyclically rotate the drum according to a preset whites cycle drum rotating schedule,
    - wherein the preset whites maintenance phase liquid level is equal to or less than the preset normal maintenance phase liquid level.

2. The laundry washing machine of claim 1, wherein the operating instructions further comprise instructions to receive a cycle modifier from the user interface, and modify at least one of the default normal cycle liquid level and the default whites cycle liquid level in response to receiving the cycle modifier.

3. The laundry washing machine of claim 1, wherein the preset normal maintenance phase liquid level is 0.10% to 0.26% of a total interior volume of the drum.

4. The laundry washing machine of claim 1, wherein the preset normal maintenance phase liquid level is 0.16% to 0.20% of a total interior volume of the drum.

5. The laundry washing machine of claim 4, wherein the preset whites maintenance phase liquid level is 0.16% to 0.20% of the total interior volume of the drum.

6. The laundry washing machine of claim 1, wherein the predefined whites laundry cycle program further comprises default instructions for operating the heater to obtain a target temperature in the liquid of at least 48° C. at an end of the whites maintenance phase.

7. The laundry washing machine of claim 1, wherein the predefined whites laundry cycle program further comprises default instructions for operating the heater during at least 75% of the whites wash maintenance phase.

8. The laundry washing machine of claim 1, wherein:
- the predefined normal laundry cycle program further comprises respective default instructions for:
  - draining the liquid from the tub during a normal dehydration phase, and
  - operating the valve one or more times to fill the drum to a default normal rinse phase liquid level; and
- the predefined whites laundry cycle program further comprises respective default instructions for:
  - draining the liquid from the tub during a whites dehydration phase, and
  - opening the valve one or more times to fill the drum to a default whites rinse phase liquid level,
  - wherein the default whites rinse phase liquid level is greater than the default normal rinse phase liquid level.

9. The laundry washing machine of claim 8, wherein opening the valve one or more times to fill the drum to the default normal rinse phase liquid level comprises opening the valve to add 20 liters to 30 liters of water to the tub.

10. The laundry washing machine of claim 8, wherein opening the valve one or more times to fill the drum to the default normal rinse phase liquid level comprises opening the valve to add 23 liters to 27 liters of water to the tub.

11. The laundry washing machine of claim 10, wherein opening the valve one or more times to fill the drum to the default whites rinse phase liquid level comprises opening the valve to add 30 to 35 liters of water to the tub.

12. The laundry washing machine of claim 8, wherein:
- opening the valve one or more times to fill the drum to the default normal rinse phase liquid level comprises opening the valve to add a first volume of water to the tub;

opening the valve one or more times to fill the drum to the default whites rinse phase liquid level comprises opening the valve to add a second volume of water to the tub; and the second volume is 110% to 135% of the first volume of water.

13. The laundry washing machine of claim 8, wherein:

opening the valve one or more times to fill the drum to the default normal rinse phase liquid level comprises opening the valve to add a first volume of water to the tub;

opening the valve one or more times to fill the drum to the default whites rinse phase liquid level comprises opening the valve to add a second volume of water to the tub; and the second volume is 130% of the first volume of water.

14. The laundry washing machine of claim 1, wherein the laundry washing machine further comprises a recirculation pump configured to pump liquid from the tub to a location in an upper half of the drum, and the predefined whites laundry cycle program further comprises default instructions for operating the recirculation pump during regular intervals throughout the whites maintenance phase.

15. The laundry washing machine of claim 14, wherein the default instructions for operating the recirculation pump during regular intervals throughout the whites maintenance phase comprises instructions to operate the recirculation pump during at least 50% of the whites maintenance phase.

16. The laundry washing machine of claim 1, wherein:

the laundry washing machine further comprises a recirculation pump configured to pump liquid from the tub to a location in an upper half of the drum;

the predefined normal laundry cycle program further comprises instructions for operating the recirculation pump during 20% or less than the normal wash maintenance phase; and the predefined whites laundry cycle program further comprises default instructions for operating the recirculation pump during at least 50% the whites maintenance phase.

17. The laundry washing machine of claim 1, wherein:

the normal maintenance phase has a first time duration;

the normal whites maintenance phase has a second time duration; and the second time duration is at least twice as long as the first time duration.

18. A method for operating a laundry washing machine comprising: a cabinet; a tub mounted within the cabinet; a drum rotatably mounted within the tub; a drum motor configured to rotate the drum; a water supply; a valve selectively openable to direct water from the water supply to the tub; a heater; and a user interface configured to receive a laundry cycle selection; the method comprising:

receiving the laundry cycle selection from the user interface;

identifying the laundry cycle selection from a plurality of laundry cycle selection options including at least a normal laundry cycle and a whites laundry cycle;

upon receiving a selection of the normal laundry cycle during a first operation of the laundry washing machine, automatically executing a predefined normal laundry cycle program comprising:

opening the valve one or more times to fill the drum to a preset unmodifiable normal maintenance phase liquid level, and operating the drum motor during a normal maintenance phase to cyclically rotate the drum according to a preset normal cycle drum rotating schedule; and upon receiving a selection of the whites laundry cycle during a second operation of the laundry washing machine, automatically executing a predefined whites laundry cycle program comprising:

opening the valve one or more times to fill the drum to a preset unmodifiable whites maintenance phase liquid level, and operating the drum motor during a whites maintenance phase to cyclically rotate the drum according to a preset whites cycle drum rotating schedule, wherein the preset whites maintenance phase liquid level is equal to or less than the preset normal maintenance phase liquid level.

19. The method of claim 18, further comprising operating the heater to obtain a target temperature in the liquid of at least 48° C. at an end of the whites maintenance phase.

20. The method of claim 18, wherein the whites maintenance phase has a time duration at least twice as long as the normal maintenance phase.

* * * * *